United States Patent [19]

Tanaka

[11] Patent Number: 4,789,490

[45] Date of Patent: Dec. 6, 1988

[54] IMMERSION OIL COMPOSITION HAVING LOW FLUORESCENCE EMISSIONS FOR MICROSCOPE

[75] Inventor: Toshiaki Tanaka, Kudamatsu, Japan

[73] Assignee: Idemitsu Petrochemical Co., Ltd., Tokyo, Japan

[21] Appl. No.: 35,750

[22] Filed: Apr. 8, 1987

Related U.S. Application Data

[63] Continuation-in-part of Ser. No. 796,278, Nov. 8, 1985, abandoned.

[30] Foreign Application Priority Data

Jul. 15, 1985 [JP] Japan ..... 60-154335

[51] Int. Cl.[4] ..... C09K 3/00

[52] U.S. Cl. ..... 252/1; 252/582; 252/589; 252/9

[58] Field of Search ..... 252/589, 1, 8, 9, 582

[56] References Cited

U.S. PATENT DOCUMENTS

| | | | |
|---|---|---|---|
| 3,929,667 | 12/1975 | Bautis | 252/408.1 |
| 3,979,301 | 9/1976 | Ushioda | 252/1 |
| 4,122,023 | 10/1978 | Yasui | 252/59 |
| 4,465,621 | 8/1984 | Sacher | 252/582 |
| 4,491,533 | 1/1985 | Sacher | 252/582 |
| 4,493,533 | 1/1985 | Petrzilka | 350/418 |
| 4,526,711 | 7/1985 | Sacher | 252/582 |

OTHER PUBLICATIONS

Hawley, Ed., "Condensed Chem. Dict., 9th Ed." pp. 247, 250, 285, 290, 291, 308, 351, 557.

Brandrup Ed., "Polymer Handbook" 2nd Ed., John Wiley & Sons, pp. V1–V5, V7–V12.

Rubber World, Blue Book, Materials and Compounding Ingredients for Rubber, 1975, Bill Communications, "Polybutadienes, Polyisoprenes".

Chemistry of High Polymers, John Wiley & Sons, 1958, pp. 108–113.

*Primary Examiner*—Matthew A. Thexton

*Assistant Examiner*—Catherine S. Kilby

*Attorney, Agent, or Firm*—Frishauf, Holtz, Goodman & Woodward

[57] ABSTRACT

The invention provides an immersion oil composition for microscope especially suitable for use in the microscopic study using a fluorescence microscope by virtue of the greatly decreased fluorescence emission under ultraviolet irradiation in comparison with conventional immersion oils. The inventive immersion oil composition comprises a liquid dienic polymer, e.g. liquid polybutadiene, as a first component and, as a second component, one or a combination of compounds including (a) chlorinated paraffins, (b) polybutene, (c) carboxylic acid esters, (d) liquid paraffins, (e) saturated aliphatic alcohols and (f) alicyclic alcohols; said composition having a refractive index in the from 1.501 to 1.519 and a Abbe's number in the range from 40 to 46.

13 Claims, No Drawings

IMMERSION OIL COMPOSITION HAVING LOW FLUORESCENCE EMISSIONS FOR MICROSCOPE

CROSS REFERENCE TO OTHER APPLICATION

This application is a continuation-in-part of application Ser. No. 796,278, filed Nov. 8, 1985 now abandoned.

BACKGROUND OF THE INVENTION

The present invention relates to an immersion oil composition having low fluorescence emissions for microscope or, more particularly, to an immersion oil suitable for use in fluorescence microscope.

When it is desired to gain an increased magnification of a microscope, the so-called immersion method is conventionally undertaken to increase the numerical aperture of the objective lens. Various kinds of oily liquids are known and used in the prior art as an immersion oil for microscope including glycerin, silicone fluids, those mainly composed of a polychlorinated biphenyl, i.e. PCB, referred to as a PCB oil hereinbelow, and the like. These known immersion oils have their respective problems and disadvantages. For example, glycerin is defective as an immersion oil due to the hygroscopicity and low refractive index thereof. Silicone fluids are also not quite satisfactory due to the low refractive index in addition to the relatively high viscosity thereof to cause some inconvenience. PCB oil is a notoriously toxic material so that the use thereof in such an application should be avoided.

The inventor has previously developed and proposed an immersion oil for microscope free from the problems and disadvantages in the prior art immersion oils mentioned above, which is a mixture of a specific linear hydrocarbon compound and an additive such as diphenyl methane and the like (see Japanese patent publication No. 35053/1980). Although quite satisfactory for general microscopic uses, the immersion oil of this type is not suitable as an immersion oil for fluorescence microscope used in the microscopic study of a body emitting fluorescence.

SUMMARY OF THE INVENTION

The object of the present invention is therefore to provide an immersion oil composition having low fluorescence emissions for microscope free from the above described disadvantages of the prior art immersion oils or, more particularly, to provide an immersion oil composition for fluorescence microscope with greatly reduced emission of fluorescence to give quite satisfactory results even in the microscopic studies of a fluorescent body using a fluorescence microscope.

Thus, the immersion oil of the present invention for microscope is a liquid composition comprising 100 parts by weight of a first component which is a liquid dienic polymer and 3 to 200 parts by weight of a second component which is one or a combination of compounds selected from the groups consisting of:

(a) chlorinated paraffins;
(b) polybutene;
(c) carboxylic acid esters;
(d) liquid paraffins;
(e) saturated aliphatic alcohols; and
(f) alicyclic alcohols, wherein the carboxylic acid ester belonging to the group (c) is selected from the class consisting of methyl acetate, ethyl acetate, dicyclopentyl acetate, dimethyl maleate, diethyl maleate, dimethyl fumarate, diethyl fumarate and dioctyl sebacate; the saturated aliphatic alcohol belonging to the group (e) is selected from the class consisting of hexyl alcohol, heptyl alcohol and octyl alcohol; and the alicyclic alcohol belonging to the group (f) is selected from the class consisting of tricyclodecanol, tricyclododecanol, tricyclodecenol and tricyclododecenol; said composition having a refractive index in the range from 1.501 to 1.519 and a Abbe's number in the range from 40 to 46.

DETAILED DESCRIPTION OF THE PREFERRED EMBODIMENTS

The first component in the inventive immersion oil composition is a liquid dienic polymer exemplified by liquid polybutadiene, liquid polyisoprene, liquid polychloroprene and the like, of which liquid polybutadiene is particularly preferable. The liquid dienic polymer should preferably have a number-average molecular weight in the range from 500 to 20,000 or, more preferably, from 1,000 to 15,000. The liquid dienic polymer may have some functional groups such as hydroxy groups and carboxyl groups.

The second component admixed with the above mentioned liquid dienic polymer is one or a combination of the compounds belonging to the groups (a) to (f) defined above. As the compound belonging to the group (a), chlorinated paraffins are used. The chlorinated paraffin should contain from 10 to 80% by weight or, preferably, from 20 to 70% by weight of chlorine and should have an acid value in the range from 0.01 to 0.50 mg KOH/g, viscosity in the range from 0.5 to 40,000 poise at 25° C., specific gravity in the range from 1.100 to 1.800 at 25° C. and hue in the range from 50 to 350 (APHA).

As the compound belonging to the group (b), polybutene is used. The polybutene should have a number-average molecular weight in the range from 200 to 10,000 or, preferably, from 300 to 8,000.

The term "polybutene" implied here means homopolymer of 1-butene, trans-2-butene, cis-2-butene or isobutyrene, or copolymer of said monomer with other monomer and the polymerization products of a mixture of said monomers are also included in the copolymer.

The carboxylic acid ester belonging to the group (c) is selected from the class consisting of methyl acetate, ethyl acetate, dicyclopentyl acetate, dimethyl maleate, diethyl maleate, dimethyl fumarate, diethyl fumarate and dioctyl sebacate.

As the compound belonging to the group (d), liquid paraffins are used.

The saturated aliphatic alcohol belonging to the group (e) is selected from the class consisting of hexyl alcohol, heptyl alcohol and octyl alcohol, of which heptyl alcohol is preferable.

The alicyclic alcohol belonging to the group (f) is selected from the class consisting of tricyclodecanol, tricyclododecanol, tricyclodecenol and tricyclododecenol, of which tricyclodecanol is particularly preferable.

The inventive immersion oil composition having low fluorescence emissions for microscope can be prepared by uniformly blending the liquid dienic polymer as the first component and at least one kind of the compounds belonging to the above described groups (a) to (f) as the second component.

It is essential to adequately select the kinds of the components and the blending ratio thereof in order that the resultant mixture may have properties suitable for an immersion oil for microscope including the dispersive power of light, refractive index, viscosity and others. The Abbe's number as a measure of the dispersive power of light should be in the range from 40 to 46. The refractive index of the immersion oil should be in the range from 1.501 to 1.519. Further, the immersion oil should have a viscosity in the range from 10 to 50,000 centistokes or, preferably, from 20 to 10,000 centistokes at 37.8° C. Other properties important in immersion oils for microscope include anti-volatility, low fluorescence emission, anti-weatherability, clearness, resolving power, chromatic aberration and absence of corrosiveness, i.e. inertness to any body in contact therewith.

From the standpoint of satisfying the above mentioned requirements for an immersion oil, the second component, i.e. one or a combination of the compounds belonging to the groups (a) to (f), should be admixed in an amount from 3 to 200 parts by weight or, preferably, from 5 to 150 parts by weight per 100 parts by weight of the first component, i.e. the liquid dienic polymer. The mixture of the first and the second components should be thoroughly agitated at a temperature in the range from 10° to 100° C.to ensure uniformity of blending.

The above described immersion oil composition having low fluorescence emissions for microscope according to the invention satisfies all of the above mentioned requirements for immersion oils and has absolutely no toxicity to human body. Moreover, the fluorescence emission from the inventive immersion oil for microscope is very small in comparison with conventional immersion oils. Therefore, quite satisfactory results can be obtained by use of the inventive immersion oil composition in microscopic studies, in particular, using a fluorescence microscope.

Following are the examples to illustrate the inventive immersion oil for microscope in more detail.

EXAMPLES 1 TO 15

Immersion oil compositions were prepared each by mixing the respective component compounds shown in Table 1 each in the indicated amount and agitating the mixture thoroughly for 1 hour at room temperature. The immersion oils were subjected to the evaluation of various properties to give the results shown in Table 1.

COMPARATIVE EXAMPLES 1 AND 2

A PCB oil (a product by Kergill Co., Comparative Example 1) and a silicone fluid (KF 96H, a product by Shin-Etsu Chemical Co., Comparative Example 2) were subjected to the evaluation of the properties as an immersion oil for microscope in the same manner as in Examples 1 to 5 to give the results shown in Table 1.

EXAMPLES 16 TO 31

Immersion oil compositions for microscope were prepared each by mixing a liquid dienic polymer and the compound shown in Table 1 in an indicated amount and agitating the mixture thoroughly for 4 hours at 50° C. followed by cooling to room temperature. These immersion oil compositions were subjected to the evaluation of several properties in the same manner as in the preceding examples to give the results shown in Table 1.

TABLE 1

| | | | EXAMPLE | | | | | | | | |
|---|---|---|---|---|---|---|---|---|---|---|---|
| | | | 1 | 2 | 3 | 4 | 5 | 6 | 7 | 8 | 9 |
| Formulation, parts by weight | Liquid dienic polymer | Liquid polybutadiene A*1 | 100 | 100 | 100 | 100 | 100 | 100 | 100 | 100 | 100 |
| | | Liquid polybutadiene B*2 | — | — | — | — | — | — | — | — | — |
| | | Liquid polyisoprene A*3 | — | — | — | — | — | — | — | — | — |
| | | Liquid polyisoprene B*4 | — | — | — | — | — | — | — | — | — |
| | (a) Chlorinated paraffins | Chlorinated paraffin*5 | 22 | 66 | 120 | 5 | 20 | 60 | 10 | 18 | 70 |
| | (b) Polybutene | Polybutene A*6 | — | — | — | 5 | 10 | 50 | 10 | 18 | 70 |
| | | Polybutene B*7 | — | — | — | — | — | — | — | — | — |
| | (c) Carboxylic acid esters | Dioctyl sebacate | — | — | — | — | — | — | — | — | — |
| | | Ethyl acetate | — | — | — | — | — | — | — | — | — |
| | | Dicyclopentyl acetate | — | — | — | — | — | — | — | — | — |
| | (d) Liquid paraffins | Liquid paraffin*8 | — | — | — | — | — | — | — | — | — |
| | (e) Saturated aliphatic alcohol | Heptyl alcohol | — | — | — | — | — | — | — | — | — |
| | (f) Alicyclic alcohol | Tricyclodecanol | — | — | — | — | — | — | — | — | — |
| Properties | Refractive index ($n_D^{23}$)*9 | | 1.519 | 1.515 | 1.514 | 1.519 | 1.515 | 1.507 | 1.518 | 1.515 | 1.508 |
| | Abbe's number ($\nu_D^{23}$)*10 | | 40 | 43 | 45 | 40 | 42 | 45 | 41 | 42 | 46 |
| | Kinematic viscosity (centistokes at 25° C.)*11 | | 200 | 400 | 1000 | 700 | 500 | 200 | 600 | 550 | 250 |
| | Loss on heating (wt. %)*12 | | 0.5 wt. % or less | 0.5 wt. % or less | 0.5 wt. % or less | 0.5 wt. % or less | 0.5 wt. % or less | 0.5 wt. % or less | 0.5 wt. % or less | 0.5 wt. % or less | 0.5 wt. % or less |
| | Light emission test*13 | | | | | | | | | | |
| | 24 hr | | 0 | 0 | 0 | 0 | 0 | 0 | 0 | 0 | 0 |
| | 72 hr | | 0 | 0 | 0 | 0 | 0 | 0 | 0 | 0 | 0 |
| | 120 hr | | 0 | 0 | 0 | 0 | 0 | 0 | 0 | 0 | 0 |
| | Heat deterioration test*14 | | | | | | | | | | |
| | 40° C. | | 0 | 0 | 0 | 0 | 0 | 0 | 0 | 0 | 0 |
| | 70° C. | | 0 | 0 | 0 | 0 | 0 | 0 | 0 | 0 | 0 |
| | Total acid number (mg KOH/g)*15 | | 0.1 or less | 0.1 or less | 0.1 or less | 0.1 or less | 0.1 or less | 0.1 or less | 0.1 or less | 0.1 or less | 0.1 or less |
| | Effect on dye for smear*16 | | no | no | no | no | no | no | no | no | no |
| | Transmittance (%)*17 | | | | | | | | | | |
| | 400 nm | | 95% or more | 95% or more | 95% or more | 95% or more | 95% or more | 95% or more | 95% or more | 95% or more | 95% or more |
| | 500 nm | | " | " | " | " | " | " | " | " | " |
| | 600 nm | | " | " | " | " | " | " | " | " | " |
| | 700 nm | | " | " | " | " | " | " | " | " | " |
| Evaluation | Fluorescence emission*18 | | B | B | B | B | B | B | A | A | A |
| | Anti-volatility*19 | | good | good | good | good | good | good | good | good | good |
| | Presence of toxic substance*20 | | no | no | no | no | no | no | no | no | no |
| | Appearance*21 | | good | good | good | good | good | good | good | good | good |
| | Anti-weatherability*22 | | good | good | good | good | good | good | good | good | good |
| | Corrosiveness*23 | | none | none | none | none | none | none | none | none | none |
| | Contrast*24 | | clear | clear | clear | clear | clear | clear | clear | clear | clear |
| | Resolving power*25 | | good | good | good | good | good | good | good | good | good |
| | Chromatic aberration*26 | | good | good | good | good | good | good | good | good | good |
| | Clearness*27 | | good | good | good | good | good | good | good | good | good |
| | | | EXAMPLE | | | | | | | | |

TABLE 1-continued

| | | | 10 | 11 | 12 | 13 | 14 | 15 | 16 | 17 | 18 |
|---|---|---|---|---|---|---|---|---|---|---|---|
| Formulation, parts by weight | Liquid dienic polymer | Liquid polybutadiene A*1 | 100 | 100 | 100 | — | — | — | 85 | 85 | 85 |
| | | Liquid polybutadiene B*2 | — | — | — | 100 | 100 | 100 | 15 | 15 | 15 |
| | | Liquid polyisoprene A*3 | — | — | — | — | — | — | — | — | — |
| | | Liquid polyisoprene B*4 | — | — | — | — | — | — | — | — | — |
| | (a) Chlorinated paraffins | Chlorinated paraffin*5 | 5 | 20 | 50 | 5 | 22 | 60 | — | — | — |
| | (b) Polybutene | Polybutene A*6 | — | — | — | — | — | — | — | — | — |
| | | Polybutene B*7 | — | — | — | — | — | — | — | — | — |
| | (c) Carboxylic acid esters | Dioctyl sebacate | 5 | 10 | 50 | — | — | — | — | — | — |
| | | Ethyl acetate | — | — | — | 5 | 15 | 50 | — | — | — |
| | | Dicyclopentyl acetate | — | — | — | — | — | — | — | — | — |
| | (d) Liquid paraffins | Liquid paraffin*8 | — | — | — | — | — | — | 14 | 40 | 70 |
| | (e) Saturated aliphatic alcohol | Heptyl alcohol | — | — | — | — | — | — | — | — | — |
| | (f) Alicyclic alcohol | Tricyclodecanol | — | — | — | — | — | — | — | — | — |
| Properties | Refractive index ($n_D^{23}$)*9 | | 1.518 | 1.515 | 1.503 | 1.519 | 1.515 | 1.514 | 1.515 | 1.507 | 1.501 |
| | Abbe's number ($\nu_D^{23}$)*10 | | 40 | 42 | 46 | 40 | 42 | 46 | 41 | 44 | 46 |
| | Kinematic viscosity (centistokes at 25° C.)*11 | | 700 | 450 | 350 | 600 | 450 | 200 | 900 | 700 | 450 |
| | Loss on heating (wt. %)*12 | | 0.5 wt. % or less | 0.5 wt. % or less | 0.5 wt. % or less | 0.5 wt. % or less | 0.5 wt. % or less | 0.5 wt. % or less | 0.5 wt. % or less | 0.5 wt. % or less | 0.5 wt. % or less |
| | Light emission test*13 | | | | | | | | | | |
| | 24 hr | | 0 | 0 | 0 | 0 | 0 | 0 | 0 | 0 | 0 |
| | 72 hr | | 0 | 0 | 0 | 0 | 0 | 0 | 0 | 0 | 0 |
| | 120 hr | | 0 | 0 | 0 | 0 | 0 | 0 | 0 | 0 | 0 |
| | Heat deterioration test*14 | | | | | | | | | | |
| | 40° C. | | 0 | 0 | 0 | 0 | 0 | 0 | 0 | 0 | 0 |
| | 70° C. | | 0 | 0 | 0 | 0 | 0 | 0 | 0 | 0 | 0 |
| | Total acid number (mg KOH/g)*15 | | 0.1 or less | 0.1 or less | 0.1 or less | 0.1 or less | 0.1 or less | 0.1 or less | 0.1 or less | 0.1 or less | 0.1 or less |
| | Effect on dye for smear*16 | | no | no | no | no | no | no | no | no | no |
| | Transmittance (%)*17 | | | | | | | | | | |
| | 400 nm | | 95% or more | 95% or more | 95% or more | 95% or more | 95% or more | 95% or more | 95% or more | 95% or more | 95% or more |
| | 500 nm | | " | " | " | " | " | " | " | " | " |
| | 600 nm | | " | " | " | " | " | " | " | " | " |
| | 700 nm | | " | " | " | " | " | " | " | " | " |
| Evaluation | Fluorescence emission*18 | | A | A | A | B | B | B | A | A | A |
| | Anti-volatility*19 | | good | good | good | good | good | good | good | good | good |
| | Presence of toxic substance*20 | | no | no | no | no | no | no | no | no | no |
| | Appearance*21 | | good | good | good | good | good | good | good | good | good |
| | Anti-weatherability*22 | | good | good | good | good | good | good | good | good | good |
| | Corrosiveness*23 | | none | none | none | none | none | none | none | none | none |
| | Contrast*24 | | clear | clear | clear | celar | clear | clear | clear | clear | clear |
| | Resolving power*25 | | good | good | good | good | good | good | good | good | good |
| | Chromatic aberration*26 | | good | good | good | good | good | good | good | good | good |
| | Clearness*27 | | good | good | good | good | good | good | good | good | good |
| | | | EXAMPLE | | | | | | | | |
| | | | 19 | 20 | 21 | 22 | 23 | 24 | 25 | 26 | 27 |

TABLE 1-continued

| | | | | | | | | | | | |
|---|---|---|---|---|---|---|---|---|---|---|---|
| Formulation, parts by weight | Liquid dienic polymer | Liquid polybutadiene A*1 | 99 | 99 | 99 | 56 | 56 | 56 | — | — | — |
| | | Liquid polybutadiene B*2 | 1 | 1 | 1 | — | — | — | 100 | 100 | 100 |
| | | Liquid polyisoprene A*3 | — | — | — | — | — | — | — | — | — |
| | | Liquid polyisoprene B*4 | — | — | — | 44 | 44 | 44 | — | — | — |
| | (a) Chlorinated paraffins | Chlorinated paraffin*5 | — | — | — | — | — | — | — | — | — |
| | (b) Polybutene | Polybutene A*6 | — | — | — | — | — | — | — | — | — |
| | | Polybutene B*7 | — | — | — | — | — | — | — | — | — |
| | (c) Carboxylic acid esters | Dioctyl sebacate | — | — | — | — | — | — | — | — | — |
| | | Ethyl acetate | — | — | — | — | — | — | — | — | — |
| | | Dicyclopentyl acetate | — | — | — | — | — | — | 5 | 62 | 80 |
| | (d) Liquid paraffins | Liquid paraffin*8 | 15 | 50 | 80 | 11 | 60 | 90 | — | — | — |
| | (e) Saturated aliphatic alcohol | Heptyl alcohol | — | — | — | — | — | — | — | — | — |
| | (f) Alicyclic alcohol | Tricyclodecanol | — | — | — | — | — | — | 3 | 20 | 60 |
| Properties | Refractive index ($n_D^{23}$)*9 | | 1.515 | 1.506 | 1.501 | 1.515 | 1.503 | 1.501 | 1.516 | 1.515 | 1.517 |
| | Abbe's number ($\nu_D^{23}$)*10 | | 41 | 45 | 46 | 41 | 45 | 46 | 40 | 44 | 46 |
| | Kinematic viscosity (centistokes at 25° C.)*11 | | 250 | 200 | 100 | 1900 | 1500 | 1000 | 2500 | 1000 | 800 |
| | Loss on heating (wt. %)*12 | | 0.5 wt. % or less | 0.5 wt. % or less | 0.5 wt. % or less | 0.5 wt. % or less | 0.5 wt. % or less | 0.5 wt. % or less | 0.5 wt. % or less | 0.5 wt. % or less | 0.5 wt. % or less |
| | Light emission test*13 | | | | | | | | | | |
| | 24 hr | | 0 | 0 | 0 | 0 | 0 | 0 | 0 | 0 | 0 |
| | 72 hr | | 0 | 0 | 0 | 0 | 0 | 0 | 0 | 0 | 0 |
| | 120 hr | | 0 | 0 | 0 | 0 | 0 | 0 | 0 | 0 | 0 |
| | Heat deterioration test*14 | | | | | | | | | | |
| | 40° C. | | 0 | 0 | 0 | 0 | 0 | 0 | 0 | 0 | 0 |
| | 70° C. | | 0 | 0 | 0 | 0 | 0 | 0 | 0 | 0 | 0 |
| | Total acid number (mg KOH/g)*15 | | 0.1 or less | 0.1 or less | 0.1 or less | 0.1 or less | 0.1 or less | 0.1 or less | 0.1 or less | 0.1 or less | 0.1 or less |
| | Effect on dye for smear*16 | | no | no | no | no | no | no | no | no | no |
| | Transmittance (%)*17 | | | | | | | | | | |
| | 400 nm | | 95% or more | 95% or more | 95% or more | 95% or more | 95% or more | 95% or more | 95% or more | 95% or more | 95% or more |
| | 500 nm | | " | " | " | " | " | " | " | " | " |
| | 600 nm | | " | " | " | " | " | " | " | " | " |
| | 700 nm | | " | " | " | " | " | " | " | " | " |
| Evaluation | Fluorescence emission*18 | | A | A | A | B | B | B | B | B | B |
| | Anti-volatility*19 | | good | good | good | good | good | good | good | good | good |
| | Presence of toxic substance*20 | | no | no | no | no | no | no | no | no | no |
| | Appearance*21 | | good | good | good | good | good | good | good | good | good |
| | Anti-weatherability*22 | | good | good | good | good | good | good | good | good | good |
| | Corrosiveness*23 | | none | none | none | none | none | none | none | none | none |
| | Contrast*24 | | clear | clear | clear | clear | clear | clear | clear | clear | clear |
| | Resolving power*25 | | good | good | good | good | good | good | good | good | good |
| | Chromatic aberration*26 | | good | good | good | good | good | good | good | good | good |
| | Clearness*27 | | good | good | good | good | good | good | good | good | good |

| | | | EXAMPLE | | | | COMPARATIVE EXAMPLE | |
|---|---|---|---|---|---|---|---|---|
| | | | 28 | 29 | 30 | 31 | 1 | 2 |
| Formulation, | Liquid dienic | Liquid polybutadiene A*1 | — | — | — | — | | |

TABLE 1-continued

| | | | | | | | | |
|---|---|---|---|---|---|---|---|---|
| parts by weight | polymer | Liquid polybutadiene B*2 | — | — | — | — | | |
| | | Liquid polyisoprene A*3 | 100 | 100 | 100 | 100 | | |
| | | Liquid polyisoprene B*4 | — | — | — | — | | |
| | (a) Chlorinated paraffins | Chlorinated paraffin*5 | — | — | — | — | | |
| | (b) Polybutene | Polybutene A*6 | — | — | — | — | | |
| | | Polybutene B*7 | 15 | 64 | 70 | — | | |
| | (c) Carboxylic acid esters | Dioctyl sebacate | — | — | — | — | | |
| | | Ethyl acetate | — | — | — | — | | |
| | | Dicyclopentyl acetate | — | — | — | — | | |
| | (d) Liquid paraffins | Liquid paraffin*8 | — | — | — | — | | |
| | (e) Saturated aliphatic alcohol | Heptyl alcohol | — | — | — | 25 | | |
| | (f) Alicyclic alcohol | Tricyclodecanol | 5 | 36 | 60 | — | | |
| Properties | Refractive index ($n_D^{23}$)*9 | | 1.519 | 1.515 | 1.516 | 1.515 | 1.515 | 1.402 |
| | Abbe's number ($\nu_D^{23}$)*10 | | 41 | 45 | 46 | 44 | 42 | 52 |
| | Kinematic viscosity (centistokes at 25° C.)*11 | | 2800 | 2000 | 1400 | 3100 | 120 | 3000 |
| | Loss on heating (wt. %)*12 | | 0.5 wt. % or less | 0.5 wt. % or less | 0.5 wt. % or less | 0.5 wt. % or less | 0.5 wt. % or less | 0.5 wt. % or less |
| | Light emission test*13 | | | | | | | |
| | 24 hr | | 0 | 0 | 0 | 0 | 0 | 0 |
| | 72 hr | | 0 | 0 | 0 | 0 | 0 | 0 |
| | 120 hr | | 0 | 0 | 0 | 0 | 0 | 0 |
| | Heat deterioration test*14 | | | | | | | |
| | 40° C. | | 0 | 0 | 0 | 0 | 0 | 0 |
| | 70° C. | | 0 | 0 | 0 | 0 | 0 | 0 |
| | Total acid number (mg KOH/g)*15 | | 0.1 or less | 0.1 or less | 0.1 or less | 0.1 or less | 0.1 or less | 0.1 or less |
| | Effect on dye for smear*16 | | no | no | no | no | no | no |
| | Transmittance (%)*17 | | | | | | | |
| | 400 nm | | 95% or more | 95% or more | 95% or more | 95% or more | 95% or more | 95% or more |
| | 500 nm | | " | " | " | " | " | " |
| | 600 nm | | " | " | " | " | " | " |
| | 700 nm | | " | " | " | " | " | " |
| Evaluation | Fluorescence emission*18 | | B | B | B | B | B | B |
| | Anti-volatility*19 | | good | good | good | good | good | good |
| | Presence of toxic substance*20 | | no | no | no | no | yes | no |
| | Appearance*21 | | good | good | good | good | good | good |
| | Anti-weatherability*22 | | good | good | good | good | good | good |
| | Corrosiveness*23 | | none | none | none | none | none | none |
| | Contrast*24 | | clear | clear | clear | clear | clear | rather cloudy |
| | Resolving power*25 | | good | good | good | good | good | poor |
| | Chromatic aberration*26 | | good | good | good | good | good | poor |
| | Clearness*27 | | good | good | good | good | good | good |

Footnotes to Table 1

*1Liquid polybutadiene having a viscosity of 750 centipoise at 25° C. and a number-average molecular weight of 1600.

*2Liquid polybutadiene terminated at molecular chain ends with hydroxy groups having a number-average molecular weight of 2800 and a hydroxy value of 0.80 meq./g (Poly-bd R-45HT, a product by Idemitsu Petrochemical Co., Ltd.)

*3Kuraprene LIR-30 having a viscosity-average molecular weight of 29,000 (a product by Kuraray Co.)

TABLE 1-continued

*4Liquid polyisoprene terminated at molecular chain ends with hydroxy groups having a number-average molecular weight of 2120 and a hydroxy value of 0.81 meq./g
*5Chlorinated normal paraffin containing 59.3% by weight of chlorine and having an acid value of 0.08 mg KOH/g, viscosity of 25.8 poise at 25° C., specific gravity of 1.377 at 25° C. and hue of 70 (APHA)
*6"Idemitsu Polybutene" having a number-average molecular weight of 400 (a product by Idemitsu Petrochemical Co., Ltd.)
*7"Idemitsu Polybutene" having a number-average molecular weight of 940 (a product by Idemitsu Petrochemical Co., Ltd.)
*8"Daphne Oil CP" (a product by Idemitsu Kosan Co., Ltd.)
*9Refractive index ($n_D^{23}$): Measured according to JIS-K-2101
*10Abbe's number ($\nu_D^{23}$): Measured according to JIS-K-2101
*11Kinematic viscosity (cst (25° C.)): Measured according to JIS-K-2283
*12Loss on heating (wt. %): Shows the loss on heating when heated at 30° C. for 24 hours according to JIS-C-2101 "Electric Insulation Oil", 12. evaporation test.
*13Light emission test: A prescribed quantity (40 ± 0.5 g) of sample was taken to Shale (9 cm $\phi$), and the change in refractive index was observed after a light (Hi-light white ball FL 20W by Matsushita Electric Industries Co., Ltd. was used as a light source, and the distance between the lamp and the sample was set to be 15 cm) was emitted for the prescribed periods (24, 72, 120 hrs).
*14Heat deterioration test: A prescribed quantity (40 ± 0.5 g) of sample was taken into 50 ml Erlenmeyer flask with stopper, preserved in a thermostat tank at prescribed temperatures (40, 70° C.) for 24 hours, and after that, the change in refractive index before and after heating was observed.
*15Total acid number: Measured according to JIS-K-2501
*16Effect on dye for smear: Measured according to JIS-K-2400
*17Transmittance: Measured according to JIS-K-0115
*18Fluorescence emission: Evaluated in the following two ranks by the fluorescence strength (relative intensities of fluorescence) shown in Table 3
A . . . very small
B . . . small
*19Anti-volatility: From the result of heating loss shown in *12, evaluation was made in the following two ranks.
good . . . loss on heating is under 1 percent by weight
poor . . . loss on heating is 1 percent by weight or larger
*20Presence of toxic substance: Presence of PCB or heavy metals was checked.
*21Appearance: Sample was taken into a clean glass container, and turbidity or dust was visually inspected to evaluate in the following two ranks.
good . . . no turbidity nor dust
poor . . . turbidity or dust detected
*22Anti-weatherability: According to the result of the light emission test shown in *13 and the result of the heat deterioration test shown in *14 as well as the change in Abbe's number and hue before and after the said test, evaluation was made in the following two ranks.
good . . . no change was found in refractive index, Abbe's number, or hue
poor . . . any change was found in refractive index, Abbe's number, or hue
Hue was measured according to ASTM-D-1209.
*23Corrosiveness: From the result of measurement of the total acid number shown in *15 and measurement of the effect on the dye for smear shown in *16, the presence of corrosiveness was evaluated.
*24Contrast: In a microscope employing the present immersion oil, evaluation was made on three ranks of clear, rather cloudy, and cloudy, by seeing the white and black lines cut on the white and black plate by chrome-evaporation. The lines were cut at the rate of 300 lines/mm or 600 lines/mm.
*25Resolving power: By refractive index shown in *9, evaluation was made on following two ranks.
good . . . refraction index is in the range of 1.501–1.519
poor . . . refraction index is beyond the range of 1.501–1.519
*26Chromatic aberration: By the Abbe's number shown in *10, evaluation was made on the following two ranks.
good . . . Abbe's number is in the range of 40–46
poor . . . Abbe's number is beyound the range of 40–46
*27Clearness: By the transmittance shown in *17, the evaluation was made on the following three ranks.
good . . . all the transmittances of 400 nm, 500 nm, 600 nm, 700 nm are 95% or more
rather poor . . . the transmittances of 400 nm, 500 nm, 600 nm, 700 nm are 90% or more and under 95%
poor . . . the transmittances of 400 nm, 500 nm, 600 nm, 700 nm are under 90%

COMPARATIVE EXAMPLES 3 TO 9

Immersion oil composition were prepared in the same manner as in Examples 1 to 15 with exception that polybutene was used instead of a liquid dienic polymer as a first component.

In each example, the compounding ratio of the components were varied to obtain a immersion oil composition having a refractive index in the range from 1.501 to 1.519 and a Abbe's number in the range from 40 to 46.

However, in Comparative Examples 4 to 8, the immersion oil composition having the refractive index and/or Abbe's numer in the abovementioned range could not be obtained even when the compounding ratio was varied.

In Comparative Examples 3 and 9, an immersion oil composition having the refractive index in the above range could be obtained, but an immersion oil composition having also the Abbe's number in the above range could not be obtained even when the compounding ratio was varied. The typical results are shown in Table 2.

Table 2 show that an immersion oil composition which satisfies the above two values required could not be obtained by any means.

TABLE 2

| | | | Comparative Example | | | | | | |
|---|---|---|---|---|---|---|---|---|---|
| | | | 3 | 4 | 5 | 6 | 7 | 8 | 9 |
| Formulation parts by weight | First Component | Polybutene*1 | 100 | 100 | 100 | 100 | 100 | 100 | 100 |
| | Second Component | | | | | | | | |
| | (a) | Chlorinated paraffin*2 | 650 | — | — | — | — | — | — |
| | (c) | Dioctyl sebacate | — | 100 | — | — | — | — | — |
| | (c) | Ethyl acetate | — | — | 100 | — | — | — | — |
| | (c) | Dicyclopentyl acetate | — | — | — | 100 | — | — | — |
| | (d) | Liquid paraffin*3 | — | — | — | — | 100 | — | — |
| | (e) | Heptyl alcohol | — | — | — | — | — | 100 | — |
| | (f) | Tricyclo decanol | — | — | — | — | — | — | 260 |
| Properties | Refractive index ($n_D^{23}$)*4 | | 1.515 | 1.500 | 1.430 | 1.495 | 1.480 | 1.455 | 1.515 |
| | Abbe's number ($\nu_D^{23}$)*5 | | 51.1 | 54.3 | 53.5 | 55.7 | 58.9 | 57.8 | 53.8 |

Footnotes to Table 2

*1Polybutene having a number-average molecular weight of 400 (a product by polymerizing isobutyrene in the presence of aluminum chloride as a catalyst)

*2Chlorinated normal paraffin containing 59.3% by weight of chlorine and having an acid value of 0.08 mg KOH/g, viscosity of 25.8 poise at 25° C., specific gravity of 1.377 at 25° C. and hue of 70 (APHA)

*3"Daphne Oil CP" (a product by Idemitsu Kosan Co., Ltd.)

*4Refractive index ($n_D^{23}$): Measured according to JIS-K-2101

*5Abbe's number ($\nu_D^{23}$): Measured according to JIS-K-2101

As is known, fluorescence microscopes are usually equipped with an ultra-high voltage mercury lamp or the like lamp as a light source from which ultraviolet light is radiated to excite fluorescence. The exciting light in this case includes U-excitation, V-excitation, B-excitation and G-excitation depending on the wave length of the ultraviolet and it is desirable that the immersion oil used in a fluorescence microscope emits fluorescence in an intensity as low as possible at each of the above mentioned excitation bands. Table 3 below summarizes the relative intensities of fluorescence emitted from the immersion oil compositions for microscope prepared in Examples 2, 5, 8, 11, 14, 16, 19, 22, 26, 29 and 31, and Comparative Examples 1 and 2 at each of the excitation bands of ultraviolet.

The relative intensities of fluorescence were measured by using a fluorometer.

TABLE 3

| | Examples | | | | | Comparative Examples | | Examples | | | | | |
|---|---|---|---|---|---|---|---|---|---|---|---|---|---|
| Exciting Light | 2 | 5 | 8 | 11 | 14 | 1 | 2 | 16 | 19 | 22 | 26 | 29 | 31 |
| U-excitation | 4.9 | 6.0 | 4.6 | 5.1 | 5.3 | 25.0 | 32.0 | 4.3 | 4.5 | 6.0 | 2.5 | 4.0 | 6.0 |
| V-excitation | 1.2 | 2.5 | 0.9 | 1.1 | 1.3 | 2.8 | 4.4 | 0.8 | 0.8 | 1.3 | 1.2 | 2.0 | 1.0 |
| B-excitation | 0.3 | 0.3 | 0.3 | 0.3 | 0.3 | 0.3 | 0.4 | 0.3 | 0.3 | 0.3 | 0.3 | 0.3 | 0.3 |
| G-excitation | 0.2 | 0.2 | 0.2 | 0.2 | 0.2 | 0.5 | 0.4 | 0.2 | 0.2 | 0.2 | 0.2 | 0.2 | 0.2 |

What is claimed is:

1. An immersion oil composition having low fluorescence emissions for microscope which comprises 100 parts by weight of a first component which is a liquid dienic polymer and 3 to 200 parts by weight of a second component which is one or a combination of compounds selected from the groups consisting of:

(a) chlorinated paraffins;
(b) polybutene;
(c) carboxylic acid esters;
(d) liquid paraffins;
(e) saturated aliphatic alcohols; and
(f) alicyclic alcohols, wherein the carboxylic acid ester belonging to the group (c) is selected from the class consisting of methyl acetate, ethyl acetate, dicyclopentyl acetate, dimethyl maleate, diethyl maleate, dimethyl fumarate, diethyl fumarate and dioctyl sebacate; the saturated aliphatic alcohol belonging to the group (e) is selected from the class consisting of hexyl alcohol, heptyl alcohol and octyl alcohol; and the alicyclic alcohol belonging to the group (f) is selected from the class consisting of tricyclodecanol, tricyclododecanol, tricyclodecenol and tricyclododecenol; said composition having a refractive index in the range from 1.501 to 1.519 and a Abbe's number in the range from 40 to 46.

2. The immersion oil composition having low fluorescence emissions for microscope as claimed in claim 1 wherein the amount of the second component is in the range from 5 to 150 parts by weight per 100 parts by weight of the first component.

3. The immersion oil composition having low fluorescence emissions for microscope as claimed in claim 1 wherein the liquid dienic polymer as the first component is selected from the group consisting of liquid polybutadienes, liquid polyisoprenes and liquid polychloroprenes.

4. The immersion oil composition having low fluorescence emissions for microscope as claimed in claim 1 wherein the liquid dienic polymer as the first component has a number-average molecular weight in the range from 500 to 20,000.

5. The immersion oil composition having low fluorescence emissions for microscope as claimed in claim 1 which contains chlorinated paraffin belonging to the group (a) of the second component which contains from 10 to 80% by weight of chlorine and has an acid value in the range from 0.01 to 0.50 mg of KOH/g, a viscosity in the range from 0.5 to 40,000 poise at 25° C., a specific gravity in the range from 1.100 to 1.800 at 25° C. and a hue in the range from 50 to 350 (APHA).

6. The immersion oil composition having low fluorescence emissions for microscope as claimed in claim 1 wherein the polybutene belonging to the group (b) of the second component has a number-average molecular weight in the range from 200 to 10,000.

7. The immersion oil composition having low fluorescence emissions for microscope as claimed in claim 3 wherein the liquid dienic polymer as the first component is a liquid polybutadiene.

8. The immersion oil composition having low fluorescence emissions for microscope as claimed in claim 3 wherein the liquid dienic polymer as the first component is a liquid polyisoprene.

9. The immersion oil composition having fluorescence emissions for microscope as claimed in claim 3 wherein the liquid dienic polymer as the first component has a number-average molecular weight in the range from 1,000 to 15,000.

10. The immersion oil composition having low fluorescence emissions for microscope as claimed in claim 1 having a viscosity in the range from 10 to 50,000 centistokes at 37.8° C.

11. The immersion oil composition having low fluorescence emissions for microscope as claimed in claim 1 wherein the liquid dienic polymer as the first component has a number-average molecular weight in the range from 1,000 to 15,000.

12. The immersion oil composition having low fluorescence emissions for microscope as claimed in claim 11 wherein the liquid dienic polymer as the first component is a liquid polybutadiene.

13. The immersion oil composition having low fluorescence emissions for microscope as claimed in claim 11 wherein the liquid dienic polymer as the first component is a liquid polyisoprene.

* * * * *